United States Patent [19]

Siegel

[11] Patent Number: 4,928,495

[45] Date of Patent: May 29, 1990

[54] SELF COOLING AND SELF HEATING CONTAINER

[76] Inventor: Israel Siegel, 2980 Point East Dr., Apt. D-612, North Miami Beach, Fla. 33160

[21] Appl. No.: 369,828

[22] Filed: Jun. 22, 1989

[51] Int. Cl.[5] ..... F25D 5/00

[52] U.S. Cl. ..... 62/4; 62/294; 62/480; 126/262

[58] Field of Search ..... 62/4, 294, 480; 126/262, 263

[56] References Cited

U.S. PATENT DOCUMENTS

| | | | |
|---|---|---|---|
| 2,759,337 | 8/1956 | Katz | 62/4 |
| 2,968,932 | 1/1961 | Vance et al. | 62/4 |
| 3,379,025 | 4/1968 | Donnelly | 62/4 |
| 3,726,106 | 4/1973 | Jaeger | 62/294 |
| 3,970,068 | 7/1976 | Sato | 62/294 X |
| 4,054,037 | 10/1977 | Yoder | 62/294 X |
| 4,250,720 | 2/1981 | Siegel | 62/480 |
| 4,736,599 | 4/1988 | Siegel | 62/294 |
| 4,759,191 | 7/1988 | Thomas et al. | 62/101 |
| 4,773,389 | 9/1988 | Hamasaki | 62/4 X |
| 4,802,343 | 2/1989 | Rudick et al. | 62/4 X |

*Primary Examiner*—Lloyd L. King
*Attorney, Agent, or Firm*—Leonard Belkin

[57] ABSTRACT

Self cooling and self heating beverage containers utilizing water, the boiling point of which has been lowered by a vacuum as the working cooling fluid. A dessicant in a separate container sorbs the vapor generated by the boiling water. The sorption of vapor by the dessicant raises the temperature of the dessicant and limits its vapor sorbing abilities. Provision is made to lower the temperature of the dessicant chamber. In one version of the invention the dessicant chamber is constructed of good heat conducting material, and is immersed in a water bath, to lower the temperature of the dessicant chamber. Alternatively, the outside surfaces of the dessicant chamber are coated with a wick like material. Pre-packaged water is provided to wet the coated dessicant chamber surfaces. The dessicant chamber is then cooled by natural evaporation of the water. In a related improvement, a beverage to be heated is used instead of water as the cooling medium. A single unit of the invention can thus serve as both a cooling and heating device.

14 Claims, 3 Drawing Sheets

SELF COOLING AND SELF HEATING CONTAINERcBACKGROUND OF THE INVENTION

This invention related to self-cooling cans and in particular to improvements in sorption temperature changers.

Sorption temperature changers are described in my U.S.P Nos. 4,250,720 and 4,736,599. U.S.P. No. 4,759,191 to Thomas et al also disclosed a self-contained cooling device relying on the sorption of Vapors None of these patents discloses the present claimed invention.

Essentially, sorption temperature changers use the fact that the boiling temperature of a liquid such as water is lowered under a partial vacuum and that when boiling does occur, heat is absorbed from the surroundings.

The basic components of temperature changing systems using water are two chambers consisting of a water chamber and a desiccant chamber. The water chamber contains water under a vacuum. The water boils in the gated chamber it relatively low temperatures because of the partial vacuum in the chamber. This cools the surfaces of the water chamber. The cold surfaces of the water chamber then absorb heat from a beverage.

The removal of the vapors generated by the boiling water is essential for the initiation and continuation of the boiling of the water is the water chamber. This vapor removal is accomplished by a desiccant in the dessicant chamber which sorbs the vapors generated by the boiling water, the boiling of the water may be initiated by opening the communication between the cooling chamber and the dessicant chamber. The communication between the water and dessicant chambers is closed, the boiling of the water stops. By sorb or sorbtion herein is meant to include those processes variously described as adsorption or absorption.

Temperature chanders thus are inactive when there is no communication between the chambers and can be stored for indefinite periods of time at ambient temperatures without losing their temperature changing potential. The temperature changing action of the device will, as noted, can be initiated it any time by the opening of the communication between the water and the dessicant chambers.

The heat removed from the water chamber is delivered to the dessicant during the sorption of the water vapor by the dessicant. Since the specific heat of many dessicants is relatively small, there is a relatively large increase in temperature of the dessicants upon sorption of the vapor. The rise of the temperature reduces the ability of the dessicant to accept water vapor In the patent to Thomas et al noted above, the walls of the dessicant chamber are thermally insulated from the outside environment, and heat is taken from the dessicant by the thermal coupling of the dessicant to heat absorbing material present within the dessicant chamber. Such a device is incapable of being used as a source of heat. In addition, the heat absorbing material occupies significant space within the dessicant chamber so that a larger container is required for a given amount of cooling.

SUMMARY OF THE INVENTION

This invention concerns self cooling cans with improved efficiency of the cooling and provision for effective heating at the same time.

In one embodiment of the invention, the invention comprises one chamber containing water and another chamber containing a dessicant. Both chambers are under a vacuum, with reversible communication existing between the chambers. The vacuum causes the water in the water chamber to boil at relatively low temperatures. The vapor induced by the boiling water is removed by the dessicant in the dessicant chamber. The temperature of the water drops to its relativelY low boiling temperature. The cooled water chamber then removes heat from a beverage.

The heat removed from the water chamber is transferred to the dessicant during the sorbtion of the water vapor by the dessicant. As previously noted, the specific heat of many dessicants is relativelY small. There is, therefore, a relatively large increase in temperature of the dessicant upon sorbtion of the vapor heat by the dessicants. The rise of the temperature reduces the ability of the dessicant to accept water vapor.

One objective of the present invention is to provide low cost and efficient means for the reduction of the temperature of the dessicant. Another objective of the present invention is to provide means whereby a single unit of the invention can serve simultaneously as both a heating and a cooling device The above objectives are accomplished by adding new structures to the dessicant chamber. The volume of the dessicant chamber may thus expand to at least the volume of the can continuing the water chamber. The invention may thus take the form of a double can, or a double container. Essentially, the walls of the dessicant chamber are constructed of good heat conducting materials, and heat is lost from the dessicant by transfer of heat through the walls of the dessicant chamber. The heat loss through the walls of the dessicant chamber is enhanced by immersion of the dessicant chamber in a water bath. The water bath is placed in a container, such is a can, which encloses the dessicant chamber. The heat logs to the water in the container raises the temperature of the water.

In one modification of the invention the water in the dessicant-associated container is replaced by a beverage which requires warming or heating. Thus, the double can can by used simultaneously of both a cooling and heating device.

In another embodiment of the invention new structural components are provided to cool the outside walls of the dessicant chamber by evaporation of water. The structural components consist of wick like material which coat the outside surfaces of the walls of the dessicant chamber. Pre-packaged water is attached to the walls of the dessicant chamber The package containing the water is punctured in order to wet the walls of the dessicant chamber. The water from the wet walls evaporates naturally and cools the dessicant chamber.

These and other details of this invention will become obvious from the following detailed description of preferred embodiments of the invention.

DETAILED DESCRIPTION

Figure 1:
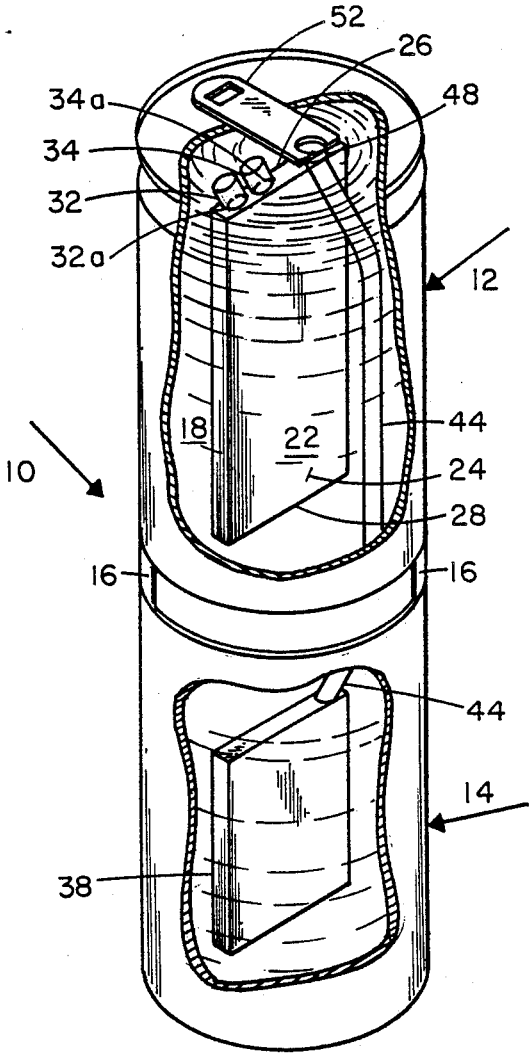
FIG. 1 is an isometric view, partially cut away, of a preferred embodiment of the invention utilizing a water bath.
Figure 2:
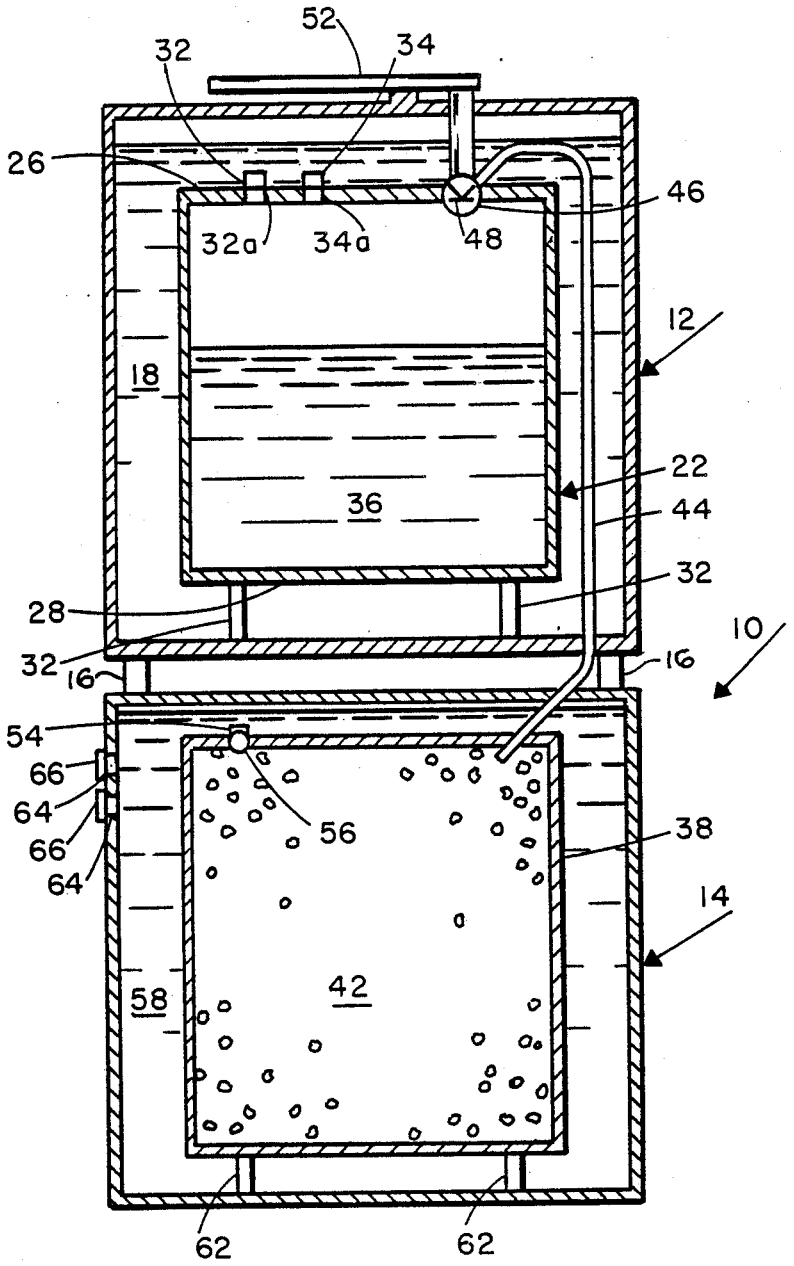
FIG. 2 is a partially schematic, cross section view of the embodiment shown in FIG. 1.

Referring to FIGS. 1 and 2, temperature changing apparats 10 consists of a beverage containing can 12 and a dessicant container 14 separated from can 12 but held together by rods or legs 16. Can 12, which may by made of standard can materials such is thin aluminum, contains a beverage 18 such as a soft drink or beer.

Present inside can 12 and immersed in beverage 18 is a water chamber 22. As seen, water chamber 22 is in the shape of a flat rectangle having flat extended side walls 24, upper wall 26, and lower wall 28. The walls 26 and 28 are relatively narrow so that container 22 is flat. Side walls 24 are relatively large and provide chamber 22 with a relatively large surface to volume ratio. Chamber 22 may be made from relatively thin aluminum such as the type of aluminum used to make standard beverage cans.

Supports 32 are attached to the bottom wall of can 12 and water chamber 22. This fixes the position of water chamber 22 in can 12.

Present on top wall 26 of chamber 22 are an outlet 32 and inlet 34. Valve 32*a* closes and opens outlet 32. Valve 34*a* closes and opens inlet 34. As described in my U.S.P. No. 4,736,599, the arrangement is such as to seal within water chamber 22 a body of water 36 under a sufficiently high vacuum such that the boiling point of water 36 is lowered to a predetermined cold temperature. For example, a vacuum of 4.6 mm Hg can be induced in the water chamber 22. This lowers the boiling point of the water to about 0 degrees C. Water 36 evaporates to form a vapor phase above the level of the liquid water 36 of chamber 22. Upon the development of the proper vacuum in chamber 22 and the introduction of the water into chamber 22, outlet 32 and inlet 34 are sealed permenantly.

Within container 14 is a sealed dessicant chamber 38. Inside chamber 38 is a dessicant 42 such as anhydrous calcium-sulfate. A pipe 44 communicates between the top of chamber 38 and the vapor phase of water 36 within chamber 22. The communication of pipe 44 with water chamber 22 occurs through an opening 46 present in the upper wall 26 of chamber 22.

Opening 46 is controlled by a valve 48 which is attached to a tab 52 which opens can 12 as is understood in the art. The arrangement is such that with tab 52 closed valve 48 is in its closed position and prevents communication between water chamber 22 and dessicant chamber 38. When tab 52 is pulled to open can 12 it also pulls valve 48 to its open position. Thus, a communication is established between the water chamber 22 and dessicant chamber 38.

Present in the upper portion of dessicant chamber 38 is an outlet 54 controlled by a valve 56. The purpose of this arrangement is to evacuate any air from chamber 38 to establish and then maintain a proper vacuum within chamber 38.

Sealed container 38 is immersed in water 58 which fills container 14. Chamber 38 is supported within container 14 by two or more legs 62 so that chamber 38 is completely surrounded by water. Openings 64 covered by caps 66 made of relatively weak material such as waxed cardboard may be used to provide relief in the event excessive pressure is developed within container 14.

Operation of apparatus 10 is as follows: With can 12 unopened (prior to pulling tab 52), valve 48 is closed so that there is a lack of communication between chambers 22 and 38. The interiors of both chambers 22 and 38 are under partial vacuum. The former is partially filled with water while the latter as filled with dessicant material 42 in granular form. Can 12 is filled with beverage 18 to be cooled while container 14 in which chamber 38 is immersed is filled with water 58.

When it is desired to gain access to and cool beverage 18, tab 52 is pulled to open can 12. This moves valve 48 to its open position. Communication between water chamber 22 and dessicant chamber 38 is then established. When this occurs the vapor in chamber 22 spreads into dessicant chamber 38 where it is sorbed by dessicant 42. Water 36 within chamber 22 boils to maintain proper vapor pressure as the vapor is removed and the process continues as dessicant 42 continues to sorb the vapor.

The boiling water 36 absorbs heat and cools the surfaces of chamber 22 and beverage 18 in contact with the walls of chamber 22. This cooling action continues until dessicant 42 is saturated with water vapor, or until the temperature of beverage 18 is diminished to the boiling temperature of the water.

As vapor is sorbed by dessicant 42 the temperature of the dessicant rises. This causes a temperature differential between dessicant chamber 38 and water 58. Heat is then transferred from dessicant 42 to water 58 and the temperature of the dessicant is lowered. The removal of heat from the dessicant as it sorbs vapor tends to maintain the effectiveness of the dessicant since the latter loses some of its ability to sorb the water vapor as its temperature rises.

Figure 3:
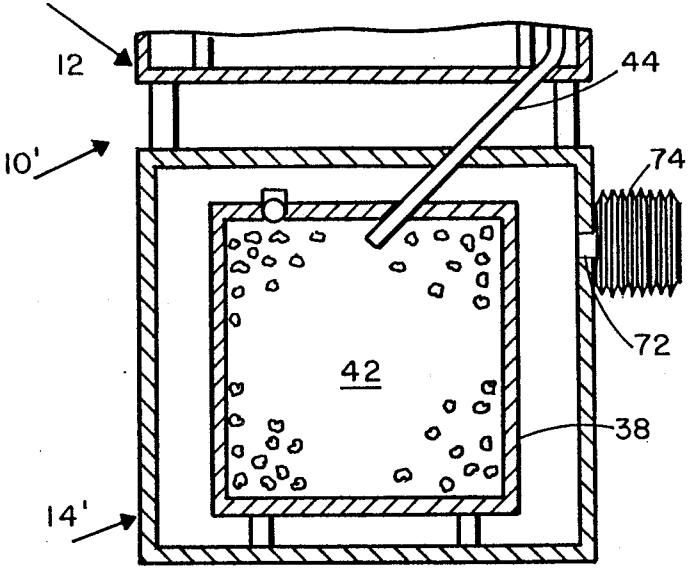
FIG. 3 is a vied similar to FIG. 2 of an alternative embodiment of the invention which can serve simultaneously as both self cooling and self heating.

FIG. 3 illustrates temperature changing apparatus 10′ identical to that shown in FIGS. 1 and 2 except that container 14′ differs from container 14 by having provision to permit the liquid to be heated to be inserted into container 14′ surrounding chamber 38. For this purpose, apparatus 10′ is ready for use with the space surrounding container 38 empty (that is, without water or other liquid). A port 72 is present on the upper side wall of container 14′. A built in folding paper or plastic funnel 74 extends from port 72. Funnel 74 closes part 72 when the funnel is in its folded position. Funnel 74 opens port 72 when funnel 74 is unfolded. Instead of funnel 74, an ordinary plug (not shown) may by employed to open or close port 72.

The operation of the invention illustrated in FIG. 3 is similar to the version of the invention described in FIGS. 1 and 2, except that before the start of the operation, the beverage to by heated is poured into container 14′ by way of port 72. During the operation of the invention the beverage which has been inserted into container 14′ around chamber 38 removes heat from the dessicant chamber 38. This enhances the cooling effect of water chamber 22 in can 12. The beverage in container 14′ is heated, for consumption at a hot temperature, in the process.

Figure 4:
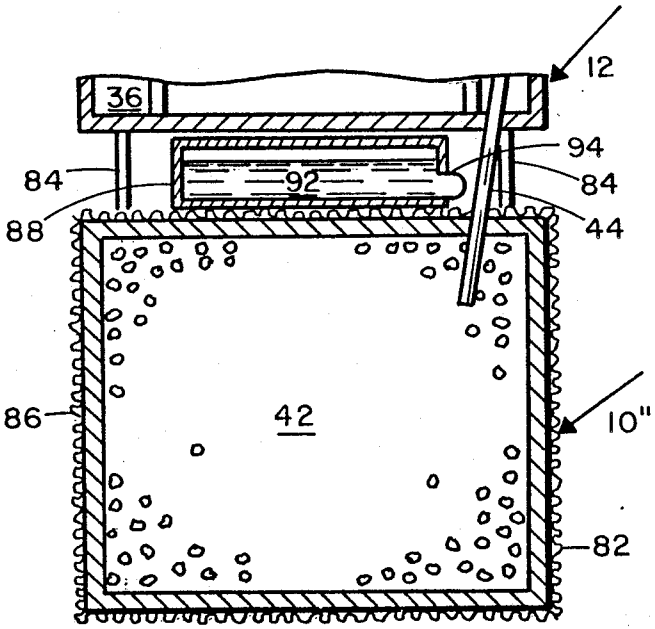
FIG. 4 is a view similar to FIG. 2 showing another embodiment of the invention in which the dessicant chamber is cooled by evaporation of water.

FIG. 4 illustrates an embodiment of the invention in which the dessicant chamber is cooled by evaporation. Apparatus 10″ consists of can 12 identical to that shown in FIGS. 1 and 2 and a dessicant chamber 82 containing dessicant 42.

Dessicant chamber 82 is similar to chamber 38 shown in FIGS. 1–3 except that chamber 82 is mounted below can 12 and supported by a plurality of rods 84. The outside surface of dessicant chamber 82 is coated with a wick like material 86 which can hold water through capillary action. Mounted on the bottom wall of can 12 in the space between can 12 and chamber 82 is a bag 88 filled with water 92. Bag 88 may be made from a fragile material such as waxed paper or thin plastic. One or more tear away tabs 94 are present adjacent the bottom of bag 88. When tab 94 is pulled, a portion of the bottom wall of bag 88 is opened, spilling water 92 to wet the wick like material 86.

The operation of the invention is similar to that described in connection with FIGS. 1 and 2, except that both tabs 52 on can 12 and 94 on bag 88 are pulled to gain access to beverage 36 and initiate cooling within can 10. Evaporation of the water from wick material 86 cools dessicant 42 and increases the efficiency of the cooling process within can 12.

While specific embodiments of the invention are illustrated in FIGS. 1–4, it is understood that the invention includes modifications which have not been illustrated, if they are within the scope of the claims For example, the apparatus has been illustrated as beverage cans. However, other types of containers, e.g. bottles, are also within the scope of the present invention. While FIG. 3 illustrates an empty container associated with the dessicant chamber, and a container with a beverage associated with the water chamber, it is understood that an empty container may likewise be associated with the water. chamber. A container with a beverage may be associated with the dessicant chamber. The cooling and heating effects may be applied not only to a beverage but also to other foods or objects.

While only certain preferred embodiments of the invention have been described it is understood that many variations are possible as defined in the claims which follow.

What is claimed is:

1. A temperature changing device consisting of a chamber, a liquid in said chamber, at least a partial air-vacuum in said chamber to lower the boiling temperature of said liquid, a second chamber, a dessicant in said second chamber, said dessicant having an affinity for vapors generated by said liquid, a communication between said vapors and said dessicant to obtain a sorption of said vapors by said dessicant, means to reversibly close said communication to obtain an unlimited storage of the temperature changing potential of said temperature changing device, a container associated with said dessicant chamber, said dessicant chamber and said container spatially arranged so that the dessicant chamber is present inside said container, water inside said container, said water and said dessicant chamber spatially arranged so that dessicant chamber is immersed in said water.

2. The device as described in claim 1 wherein said container has vapor vents.

3. A simultaneous self cooling and self heating temperature changer consisting of a chamber, a liquid in said chamber, at least a partial air-vacuum in said chamber to lower the boiling temperature of said liquid, a second chamber, a dessicant in said second chamber, said dessicant having an affinity for vapors generated by said liquid, a communication between said vapors and said dessicant to obtain a sorption of said vapor by said dessicant, means to reversibly close said communication to obtain an unlimited storage of the temperature changing potential of said temperature changing device, a container associated with said dessicant chamber, said dessicant chamber and said container spatially arranged so that the dessicant chamber is present inside said container, and an opening in said container to introduce a liquid to be heated in said container.

4. The temperature changing device of claim 3 having a collapsible funnel mounted on said container over said opening for facilitating the delivery of liquid to be heated into said container.

5. A temperature changing device consisting of a chamber, a liquid in said chamber, at least a partial air-vacuum in said chamber to lower the boiling temperature of said liquid, a second chamber, a dessicant in said second chamber, said dessicant having an affinity for vapors generated by said liquid, a communication between said vapors and said dessicant to obtain portion of said vapor by said dessicant, means to reversibly close said communication to obtain an unlimited storage of the temperature changing potential of said temperature changing device, a container associated with said dessicant chamber, said dessicant chamber and said container spatially arranged so that the dessicant chamber is present below said container, water inside said container, means to obtain an opening of the lower portion of said container to obtain the release of said water to wet the walls of said dessicant chamber to cool said dessicant chamber by natural evaporation.

6. The temperature changing device of claim 5 wherein the outside surfaces of said dessicant chamber are coated with a wick like material to facilitate the spread of said water upon said surfaces.

7. A temperature changing device consisting of a chamber, a liquid in said chamber, at least a partial air-vacuum in said chamber to lower the boiling temperature of said liquid, a second chamber, a dessicant in said second chamber, said dessicant having an affinity for vapors generated by said liquid, a communication between said vapors and said dessicant to obtain sorption of said vapor by said dessicant, means to reversibly close said communication to obtain an unlimited storage of the temperature changing potential of said temperature changing device, a container associated with said dessicant chamber, said dessicant chamber and said container spatially arranged so that the dessicant chamber is present inside said container, a heat receiving substance inside said container, said substance and said dessicant chamber spatially arranged so that dessicant chamber is in close contact with said heat receiving substance.

8. A simultaneous self cooling and self heating temperature chamber consisting of a chamber, liquid in said chamber, at least a partial air-vacuum in said chamber to lower the boiling temperature of said liquid, a second chamber, a dessicant in said second chamber, said dessicant having an affinity for vapors generated by said liquid, a communication between said vapors and said dessicant to obtain sorption of said vapor by said dessicant, means to reversibly close said communication to obtain an unlimited storage of the temperature changing potential of said temperature changing device, a container associated with at least one of said chambers and spatially arranged with respect to each other so that the chamber is present inside said container, and an opening in said containers to introduce a liquid the temperature of which is to be changed in said container.

9. Self contained heat changing apparatus comprising:

a. container means containing a sealed first chamber spaced from the walls of said container means, said first chamber containing a liquid under a partial vacuum, the sealing of said first chamber preventing the boiling of said liquid;

b. a sealed, second chamber located outside of said container means, said second chamber containing a dessicant with an affinity for the vapors of said liquid and being under a partial vacuum;

c. valve controlled means upon actuation for establishing communication between said first and second chambers to permit said dessicant to sorb vapors from said first chamber whereupon said liquid will boil producing a cooling effect; and d. means external to said second chamber for enhancing the withdrawal of heat from said second chamber to limit the temperature rise of said dessicant during adsorption of said vapors thereby to maintain the effectiveness of said dessicant while adsorbing said vapors.

10. The apparatus of claim 9 wherein said external means comprises a liquid bath.

11. The apparatus of claim 9 wherein said external means comprises means on the outer surfaces of said second chamber to evaporate a liquid to produce a cooling effect on said second chamber.

12. The apparatus of claim 11 wherein said means on the outer surfaces comprises a wick like material.

13. The apparatus of claim 12 wherein said external means includes means to wet said wick like material.

14. The apparatus of claim 9 wherein said external means comprises means to heat a product utilizing the heat generated by said dessicant.

* * * * *